US006332455B1

(12) United States Patent
Sumida et al.

(10) Patent No.: US 6,332,455 B1
(45) Date of Patent: Dec. 25, 2001

(54) DEVICE FOR CONTROLLING FUEL INJECTION

(75) Inventors: Mamoru Sumida; Norihisa Fukutomi; Osamu Matsumoto, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/688,862

(22) Filed: Oct. 17, 2000

(51) Int. Cl.[7] ..... F02M 51/00
(52) U.S. Cl. ..... 123/490; 361/154
(58) Field of Search ..... 123/490; 361/154

(56) References Cited

U.S. PATENT DOCUMENTS

| | | | |
|---|---|---|---|
| 5,975,053 | 11/1999 | Rodier . | |
| 5,992,391 | 11/1999 | Yamakado et al. . | |
| 6,234,150 * | 5/2001 | Watanabe | 361/154 |
| 6,250,286 * | 6/2001 | Hoenig et al. | 123/490 |

FOREIGN PATENT DOCUMENTS

| | | | |
|---|---|---|---|
| 0 893 594 | 1/1999 | (EP) . | |
| 0 985 814 | 4/1999 | (EP) . | |
| 60-243340 | 3/1985 | (JP) . | |
| 11-351039 | 12/1999 | (JP) | F02D/41/20 |

* cited by examiner

*Primary Examiner*—Erick Solis
(74) *Attorney, Agent, or Firm*—Sughrue Mion, PLLC

(57) ABSTRACT

A device for controlling fuel injection preventing the wasteful consumption of electric power and expanding the dynamic range for controlling the amount of fuel. The device comprises fuel pressure regulator means (4) for adjusting fuel pressure (Pf) of the fuel to be injected, injector drive means (5) including an electromagnetic coil for opening the valve body of the injector (2), and injection control means (1) for controlling the fuel regulator means and the injector drive means depending upon the operating conditions (Ne, Qa and Pf), wherein, the injection control means includes an injection timer (13) for setting the exciting time for controlling the driving time for opening the valve body by controlling the exciting current and the exciting time for the electromagnetic coil, an over-excitation timer (14) for feeding an over-exciting current, and an over-exciting period control unit (15) for variably setting the initial count value of the over-excitation timer depending upon the fuel pressure, and wherein the over-exciting period is variably set to be a minimum required limit that increases with an increase in the fuel pressure.

5 Claims, 4 Drawing Sheets

DEVICE FOR CONTROLLING FUEL INJECTION

BACKGROUND OF THE INVENTION

1. Field of the Invention

The present invention relates to a device for controlling fuel injection in feeding the fuel to an internal combustion engine depending upon the operating conditions by controlling the pressure of fuel inject ed by an injector and by controlling the driving time for opening the valve body. More particularly, the invention relates to a device for controlling fuel injection, which expands the dynamic range for controlling the amount of fuel by shortening the driving time when the valve body of the injector is opened or closed.

2. Prior Art

In the conventional direct cylinder injection-type device for controlling fuel injection in an internal combustion engine for vehicles, the valve body (electromagnetic valve) of the injector has been constituted in an internally opening type as taught in, for example, Japanese Patent Laid-Open No. 209807/1997.

In the device for controlling fuel injection of the direct cylinder injection type, a strict limitation is imposed on the timing for injecting the fuel compared with that of an ordinary intake pipe injection type and, besides, a strict limitation is imposed on the injection time for forming a favorable mixture, making it necessary to highly set the pressure of the fuel that is to be injected.

In setting the pressure of fuel, further, a dynamic range for controlling the amount of fuel must be maintained by taking into consideration the amount of fuel injection (maximum amount of injection) of when the vehicle carries a maximum load and a minimum amount of injection during the idling operation where a stratified charge combustion is taking place.

To maintain a dynamic range for controlling the amount of fuel, it can be contrived to variably set the fuel pressure.

It is considered that the method of variably setting the fuel pressure is effective in realizing an optimum state of injection in injecting the fuel through the injector.

When the injector having a valve of the internally opening type is used, the fuel pressure of the injected fuel acts in a direction to close the valve body. It therefore becomes necessary to so design the valve body of the injector that a desired valve-opening operation is accomplished at the time of a maximum fuel pressure.

In order to expand the linearity (dynamic range for controlling the amount of fuel) of the amount of injection for the injection pulse time (driving time for opening the valve body) of the injector, it is necessary to highly accurately control the opening and closing of the valve body by shortening the on/off operation time of the valve body of the injector.

To open (on) the valve body of the injector, therefore, a predetermined over-exciting current must be supplied at a sharp gradient to the electromagnetic coil for driving the valve body of the injector by using an injector drive means, and the over-exciting current must be maintained supplied over a period until the on-operation of the valve body is nearly completed.

After the on-operation of the valve body is completed, on the other hand, the electromagnetic coil produces a large electromagnetic attractive force. To maintain the valve body of the injector in a fully opened state, therefore, a minimum required holding current smaller than the over-exciting current needs be supplied to the electromagnetic coil.

In the conventional device taught in the above-mentioned publication, however, the over-exciting current and the holding current have been set to meet a maximum fuel pressure in a range of use. Therefore, the over-exciting current (and the holding current) at the time of the maximum fuel pressure are set even when the fuel pressure is controlled to lie on the lower side in the variable range.

Therefore, when, for example, the smallest fuel injection amount is to be stably controlled, it is necessary to set the fuel pressure on the lower side and to bring the time for exciting the electromagnetic coil as close to the valve-on time of the injector as possible. However, since the over-exciting period has been set to a maximum value (constant), the exciting time may become shorter than the over-exciting period.

In this case, there is substantially no period for feeding the holding current, and the state of being electromagnetically attracted by the over-exciting current shifts to the off state.

Accordingly, the valve body of the injector is opened for substantially an extended period of time, and an absolute value of the minimum amount of fuel that can be stably injected increases, resulting in a decrease in the dynamic range for controlling the amount of fuel.

This is because, in order to increase the dynamic range for controlling the amount of fuel, the valve-off time of the injector must be shortened as described above. When the valve is turned off from the state of supplying the over-exciting current (larger than the holding current), however, the initial valve-off motion is delayed compared to when the valve is turned off from the state of supplying minimum limit of current (holding current) necessary for attracting the valve body.

FIG. 4 is a diagram of waveforms illustrating the control operation of the injector by the conventional device for controlling fuel injection, and shows a relationship among the injection pulse J corresponding to the driving time for opening the valve body of the injector, an exciting current i supplied to the electromagnetic coil and an opening degree θ of the valve body in the injector.

Among the waveforms of FIG. 4, the waveform of a solid line represents a change in the time when the engine load is great (the amount of fuel injection is great and the fuel pressure is high) and the waveform of a broken line represents a change in the time when the engine load is small (amount of fuel injection is small and the fuel pressure is low).

In FIG. 4, the injection pulse J is formed by an ECU (electronic control unit) that is not shown depending upon the operating condition, is set to a relatively long pulse width t1 (see a solid line) when the engine load is large and is set to a relatively short pulse width t2 (see a broken line) when the engine load is small.

The exciting current i is set to an over-exciting current ie during an over-exciting period TE at the start of excitation of the electromagnetic coil, and is set to a holding current ih during the period of an injection pulse J after the over-exciting period TE has elapsed.

For convenience, the over-exciting current ie during the over-exciting period TE is represented by a flat waveform. In practice, however, the level of a peak current does not remain flat but varies since the current stems from the phenomenon of electric charge of a booster capacitor for sharp raising.

In this case, the over-exciting period TE is set to a predetermined value so as to become proper when the load is large (see the solid line) where the controlled fuel pressure is relatively high.

When the load is small (see the broken line), therefore, the over-exciting period TE becomes longer than the injection pulse width t2 as shown, and there is no period in which the exciting current i is decreased down to the holding current ih.

The opening degree θ of the valve body of the injector is quickly and fully opened (on state) in the initial stage of the operation for opening the valve due to the over-exciting current ie. Thereafter, the fully opened state is maintained when the load is large (see the solid line) due to the holding current ih, and the valve body returns to the fully closed (off state) due to the turn off of the exciting current i.

When it is the turn-off operation from the holding current ih as represented by the solid line, the opening degree θ of the valve body returns back to the fully closed state after a relatively short operation delay time τ1.

However, when it is the turn-off operation from the over-exciting current ie as represented by the broken line, the opening degree θ of the valve body returns to the fully closed state after the passage of an operation delay time τ2 which is longer than τ1.

When the load is small, the fuel pressure being controlled is lower than that of when the load is large. Therefore, the opening degree θ of the valve body driven by being supplied with the predetermined over-exciting current ie is brought to the fully opened state more quickly than when the load is large (see a solid line) as represented a broken line.

According to the conventional apparatus for controlling fuel injection as described above, the valve body of the injector is opened by supplying an over-exciting current to the electromagnetic coil for a predetermined over-exciting period irrespective of the driving time for opening the valve body of the injector or of the difference in the pressure for injecting the fuel. In an operating condition where the fuel is required in a small amount and the fuel pressure is low, therefore, the over-exciting period is set excessively to wastefully consume the electric power.

When the over-exciting period is set excessively, further, there does not substantially exist the period for supplying the holding current. Therefore, the valve-closing (off) operation of the injector is delayed, making it difficult to stably control the minimum amount of fuel injection and, hence, making it difficult to expand the dynamic range for controlling the amount of fuel.

SUMMARY OF THE INVENTION

The present invention was accomplished in order to solve the above-mentioned problems, and has an object of providing a device for controlling fuel injection, which prevents wasteful consumption of electric power and expands the dynamic range of controlling the amount of fuel by variably setting the over-exciting period in the initial period of opertion for opening the valve body to a minimum required limit depending upon the pressure (which is controlled depending upon the operating condition) of the fuel injected from the injector.

A device for controlling fuel injection according to the present invention comprises:

- an injector having a valve body that is opened and closed by an electromagnetic coil and a spring to inject a required amount of fuel into an internal combustion engine;
- fuel pressure regulator means for adjusting the pressure of the fuel injected from the injector;
- injector drive means for opening the valve body of the injector;
- various sensors for detecting the operating conditions of the internal combustion engine; and
- injection control means for injecting the fuel in an amount corresponding to the operating conditions through the injector by controlling the fuel pressure regulator means and the injector drive means depending upon the operating conditions; wherein,
  - the various sensors include at least a fuel pressure sensor for detecting the fuel pressure;
  - the injection control means includes an injector control unit for controlling the driving time for opening the valve body by controlling the exciting current and the exciting time for the electromagnetic coil depending upon the operating conditions and the fuel pressure;
  - the injector control unit includes:
    - an injection timer for setting the time for exciting the electromagnetic coil depending upon the amount of fuel injection to meet the operating conditions;
    - an over-excitation timer for feeding an over-exciting current to the electromagnetic coil in the initial period of the exciting time; and
    - an over-exciting period control unit for adjusting the over-exciting period in which the over-exciting current is supplied by variably setting the initial count value of the over-excitation timer depending upon the fuel pressure; the over-exciting period control unit setting the over-exciting period within a minimum required range shorter than the exciting time in a manner that the over-exciting period increases with an increase in the fuel pressure.

Thus, there is obtained a device for controlling fuel injection preventing wasteful consumption of electric power and expanding the dynamic range for controlling the amount of fuel.

In the device for controlling fuel injection according to the present invention, the over-exciting period control unit sets an over-exciting period depending upon a time required from when the electromagnetic coil is excited until when the valve body of the injector moves up to the fully opened position.

In the device for controlling fuel injection according to the present invention, the injector control unit supplies a holding current smaller than the over-exciting current to the electromagnetic coil over an exciting time after the over-exciting period has been elapsed.

In the device for controlling fuel injection according to the present invention, the injection control means includes a fuel-pressure control unit for operating the fuel pressure that becomes a target of control for the fuel pressure regulator means, and the fuel pressure control unit functions as a fuel pressure sensor and inputs the fuel pressure that serves as the target of control to the over-exciting period control unit.

Thus, there is obtained a device for controlling fuel injection omitting the fuel pressure sensor, decreasing the cost and expanding the dynamic range for controlling the amount of fuel.

In the device for controlling fuel injection according to the present invention, the device further comprises a car-mounted battery, and the injector drive means directly applies the output voltage of the battery to the injector.

Thus, there is obtained a device for controlling fuel injection that can be reduced in cost by omitting the booster capacitor for raising the voltage for the injector.

DETAILED DESCRIPTION OF THE INVENTION

Embodiment 1

An embodiment 1 of the present invention will now be described with reference to the drawings.

Figure 1:
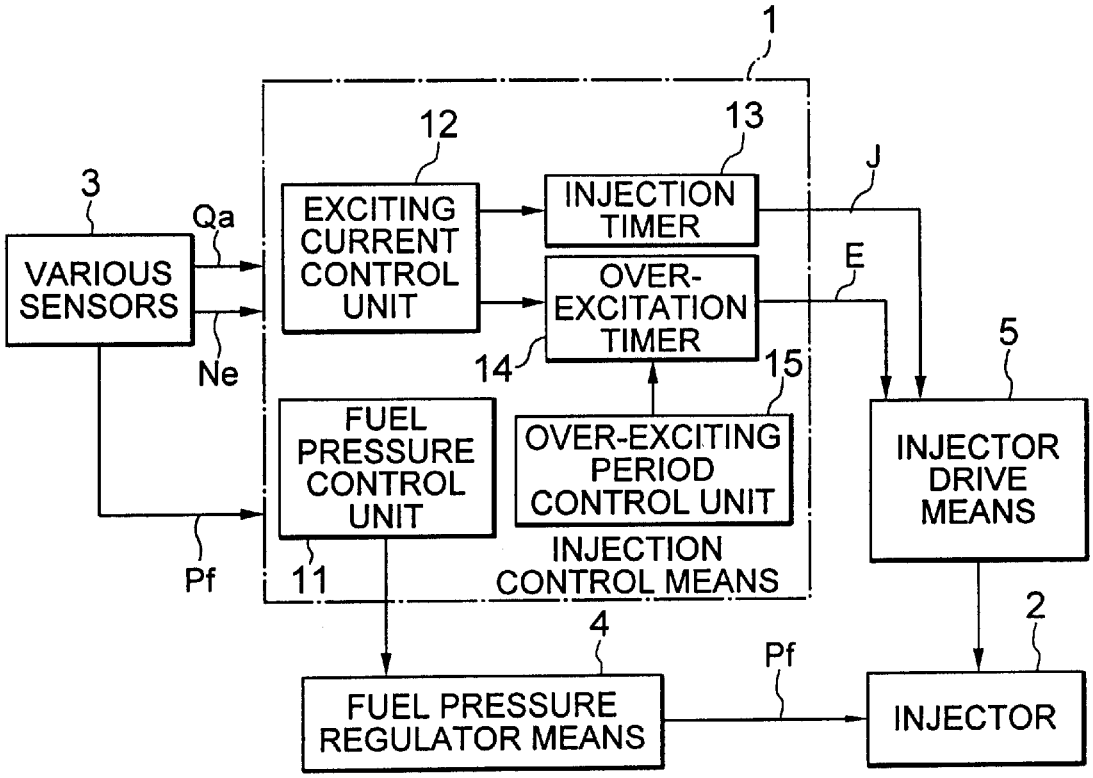
FIG. 1 is a functional block diagram illustrating an embodiment 1 of the present invention.

FIG. 1 is a functional block diagram illustrating an embodiment 1 of the present invention.

Figure 2:
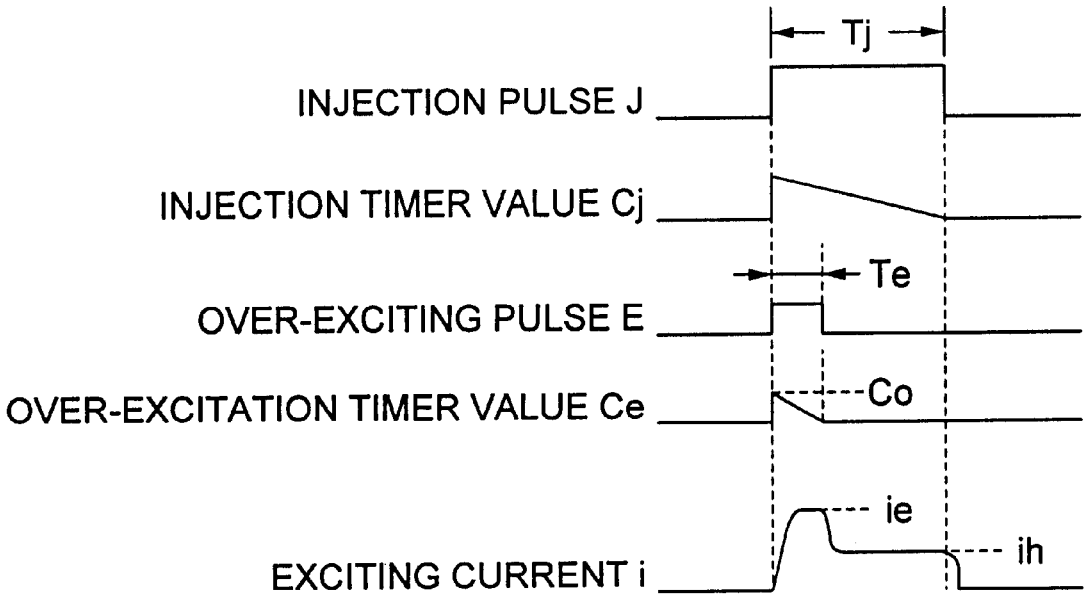
FIG. 2 is a diagram of waveforms illustrating an exciting current according to the embodiment 1 of the present invention.

FIG. 2 is a diagram of waveforms illustrating an exciting current i supplied to an electromagnetic coil (described later) in relation to the exciting time Tj (driving time for opening the valve body of the injector), injection pulse J corresponding to the over-exciting period Te, over-exciting pulse E, and timer values Cj, Ce (count values).

In FIG. 2, an over-exciting current ie is supplied to the electromagnetic coil during the over-exciting period Te in the initial period of the exciting time Tj, and a holding current ih is supplied to the electromagnetic coil during the exciting time Tj after the over-exciting period Te has been elapsed.

In FIG. 1, injection control means 1 comprises an ECU which constitutes a main body of the device for controlling fuel injection.

An injector 2 has a valve body that is opened and closed by an electromagnetic coil and a spring, and injects the fuel of a required amount into an internal combustion engine being controlled by the injection control means.

Here, none of the valve body of the injector 2, electromagnetic coil for opening the valve body, and the spring for closing the valve body are diagramed.

Various sensors 3 detect the operating conditions of the internal combustion engine and input them to the injection control means, and include an intake air amount sensor for detecting the amount Qa of the air taken in by the internal combustion engine, a rotational speed sensor for detecting the engine rotational speed Ne, and a fuel pressure sensor for detecting the pressure Pf of the fuel injected by the injector 2.

Fuel pressure regulator means 4 adjusts the pressure Pf of the fuel injected from the injector 2. Injector drive means 5 excites the electromagnetic coil to open the valve body of the injector 2.

Fuel pressure regulator means 4 and injector drive means 5 are interposed between the injection control means 1 and the injector 2, and work to supply the fuel pressure Pf and an injection signal J to the injector 2 being controlled by the injection control means.

The injector drive means 5 directly applies the output voltage of the car-mounted battery (not shown) to the injector 2. Thereby, the cost saving can be achieved by omitting the booster capacitor in the injector drive means 5 for raising voltage for the injector 2.

Various sensors 3 include at least a fuel pressure sensor for detecting the fuel pressure Pf, an intake air amount sensor for detecting the amount Qa of the air taken in by the internal combustion engine, and a rotational speed sensor for detecting the engine rotational speed Ne. The fuel pressure Pf, intake air amount Qa and the engine rotational speed Ne are input to the injection control means 1 as operating conditions.

The injection control means 1 includes the following functional elements 11 to 15 to inject the fuel in an amount that meets the operating conditions through the injector 2 by controlling the fuel pressure regulator means 4 and the injector drive means 5 depending upon the operating conditions.

A fuel pressure control unit 11 for controlling the fuel pressure regulator means 4 supplies a required fuel pressure Pf that meets the operating conditions from the fuel pressure regulator means 4 to the injector 2.

An exciting current control unit 12 controls an exciting current i to form an over-exciting current ie or a holding current ih, the exciting current i being supplied to the electromagnetic coil via the injector drive means 5.

An injection timer 13 forms an injection pulse J corresponding to the driving time (exciting time Tj) for opening the valve body of the injector 2. An over-excitation timer forms an over-exciting pulse E corresponding to the over-exciting period in the first period of the driving time for opening the valve body. An over-exciting period control unit 15 adjusts the over-exciting period Te by variably setting the initial count value Co (see FIG. 2) of the over-excitation timer 14 depending upon the fuel pressure Pf.

The exciting current control unit 12, injection timer 13, over-excitation timer 14 and the over-exciting period control unit 15 constitute an injector control unit which controls the exciting current i and the exciting time Tj for the electromagnetic coil depending upon the operating conditions inclusive of the fuel pressure Pf thereby to control the driving time for opening the valve body of the injector 2.

The injection timer 13 operates in relation to the exciting current control unit 12 and sets the exciting time Tj for the electromagnetic coil depending upon the amount of fuel injection to meet the operating conditions.

The over-excitation timer 14 operates in relation to the exciting current control unit 12 and supplies an over-exciting current ie to the electromagnetic coil in the initial period of the exciting time Tj (driving time for opening the valve body) of the electromagnetic coil.

The over-exciting period control unit 15 sets the over-exciting period Te within a minimum required range shorter than the exciting time Tj in a manner that the over-exciting period Te increases with an increase in the fuel pressure Pf.

The over-exciting period Te is set depending upon the time required from when the electromagnetic coil is excited until when the injector 2 moves up to the fully opened position.

The injection timer 13 supplies a holding current ih smaller than the over-exciting current ie to the electromagnetic coil over the exciting time Tj (period in which the injection pulse J is lasting) after the over-exciting period Te has been elapsed.

The exciting current control unit 12 sets an initial count value of the injection timer 13 depending upon the operating condition and sets the length (exciting time Tj) of the injection pulse J.

Further, the over-exciting period control unit 15 sets an initial count value Co of the over-excitation timer 14 depending upon the fuel pressure Pf and variably sets the length (over-exciting period Te) of the over-exciting pulse E.

Concrete operation of the embodiment 1 of the invention shown in FIG. 1 will now be described with reference to waveform diagrams of FIGS. 2 and 3.

Here, the description deals with only when the load is small where a delay in the operation becomes a problem concerning the opening degree θ of the valve body. FIG. 3 illustrates a case where the injection pulse J has a short pulse width t2.

When a short exciting time Tj is set by an injection pulse J of a pulse width t2, the pressure Pf of the fuel to be injected is smaller than that of when the load is high. Therefore, the over-exciting period control unit 15 sets an over-exciting period Te which is shorter than the above-mentioned over-exciting period TE (see FIG. 4).

Here, since the over-exciting period Te is set to be shorter than the pulse width t2 (exciting time Tj), the holding current ih is supplied to the electromagnetic coil over the on-period of the injection pulse J after the over-exciting period Te has been elapsed.

Figure 4:
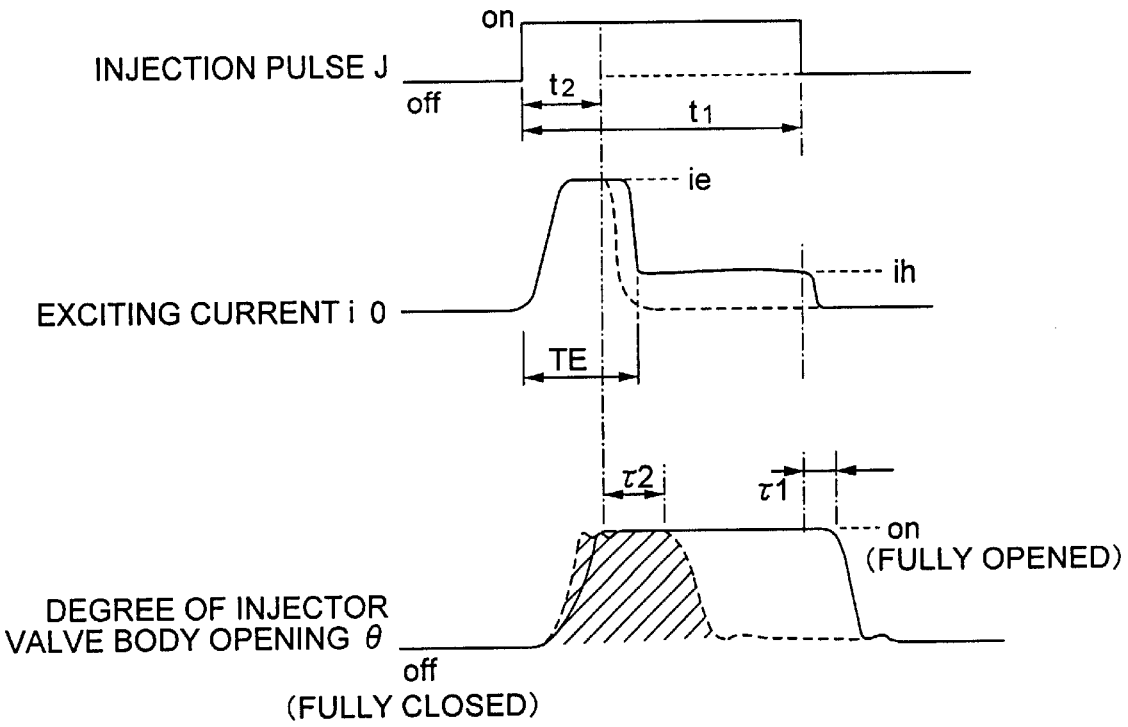
FIG. 4 is a diagram of waveforms illustrating the control operation of an injector in a conventional device for controlling fuel injection.

As a result, the valve body of the injector 2 undergoes the turn-off operation from the holding current ih, and the opening degree θ of the valve body of the injector 2 returns to the fully closed (off) state after an operation delay time τ3 which is shorter than the above-mentioned delay time τ2 (see FIG. 4).

Figure 3:
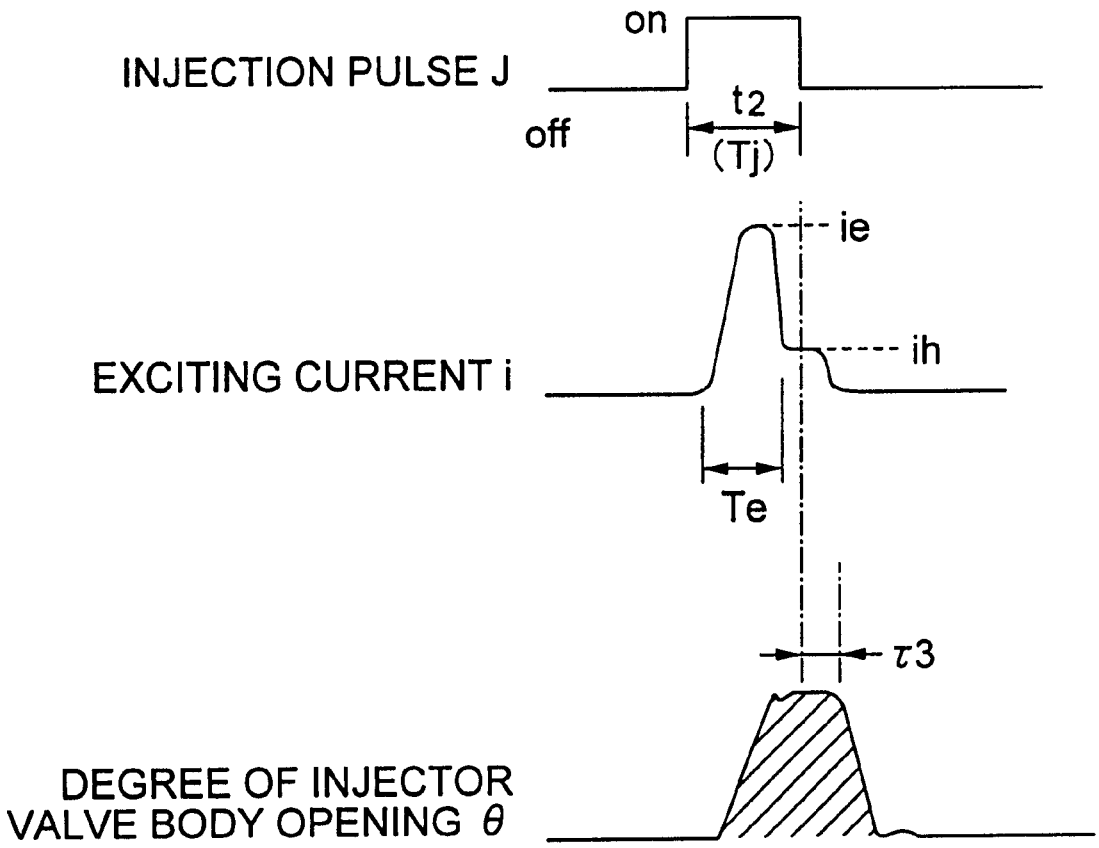
FIG. 3 is a diagram of waveforms illustrating the control operation of an injector according to the embodiment 1 of the present invention.

In the waveform of the opening degree θ of the valve body in FIG. 3, therefore, the hatched area representing the amount of fuel injection becomes smaller than the above-mentioned hatched area (see FIG. 4), and the minimum amount of fuel injection can be decreased.

The required minimum over-exciting period Te can be set depending upon the operating condition (fuel pressure Pf) to prevent wasteful consumption of electric power.

By providing the over-exciting period control unit 15 in the injection control means 1 as described above, the over-exciting period is variably controlled depending upon the fuel pressure Pf, the injection pulse J is necessarily turned off after the holding current ih is supplied to the electromagnetic coil, and the valve body of the injector 2 undergoes the turn-off operation from the state of being supplied with the holding current ih.

For example, when the fuel pressure controlled by the fuel pressure regulator means 4 is relatively high, the over-exciting period is set to be long and when the fuel pressure is relatively low, the over-exciting period is set to be short. That is, the on time of the valve body of the injector 2 is lengthened with an increase in the fuel pressure, and the injection pulse J is lengthened. Accordingly, the over-exciting period is lengthened, too.

In the internal combustion engine in which the fuel pressure Pf must be variably controlled, therefore, the minimum amount of fuel injection is controlled by decreasing the delay time in the operation for turning off the valve body of the injector 2, and the injector 2 is highly accurately controlled without impairing the dynamic range for controlling the amount of fuel.

It is therefore allowed to control the amount of fuel injection stably maintaining accuracy even in a turbo vehicle having a wide dynamic range for controlling the amount of fuel and in an ultra-lean burn-controlled vehicle.

The invention was described above by way of a preferred embodiment. As will be easily comprehended by people skilled in the art, however, the invention can be suitably changed and modified within a range of technical idea of the invention as a matter of course. Therefore, the scope of patent right shall be determined on the basis of the scope of claim for patent and on the basis of a region equivalent thereto.

Embodiment 2

In the above-mentioned embodiment, the fuel pressure sensor was provided as one of various sensors 3. By using the fuel pressure Pf which is a target of control operated from other operating conditions by the fuel pressure control unit 11, however, the fuel sensor may be omitted to decrease the cost.

In this case, the fuel pressure control unit 11 works as a fuel pressure sensor, and the fuel pressure pf operated as a target of control for the fuel pressure regulator means 4 is regarded to be a detected value and is input to the over-exciting period control unit 15.

What is claimed is:

1. A device for controlling fuel injection comprising:

an injector having a valve body that is opened and closed by an electromagnetic coil and a spring to inject a required amount of fuel into an internal combustion engine;

fuel pressure regulator means for adjusting fuel pressure of the fuel injected from the injector;

injector drive means for opening the valve body of said injector;

various sensors for detecting the operating conditions of said internal combustion engine; and injection control means for injecting the fuel in an amount corresponding to said operating conditions through said injector by controlling said fuel pressure regulator means and said injector drive means depending upon said operating conditions; wherein, said various sensors include at least a fuel pressure sensor for detecting said fuel pressure;

said injection control means includes an injector control unit for controlling a driving time for opening said valve body by controlling an exciting current and an exciting time for said electromagnetic coil depending upon said operating conditions and said fuel pressure;

said injector control unit including:

an injection timer for setting said exciting time for said electromagnetic coil depending upon the amount of fuel injection to meet said operating conditions;

an over-excitation timer for feeding an over-exciting current to said electromagnetic coil in the initial period of said exciting time; and an over-exciting period control unit for adjusting an over-exciting period in which said over-exciting current is supplied by variably setting an initial count value of said over-excitation timer depending upon said fuel pressure;

said over-exciting period control unit setting said over-exciting period within a minimum required range shorter than said exciting time in a manner so that said over-exciting period increases with an increase in said fuel pressure.

2. A device for controlling fuel injection according to claim 1, wherein said over-exciting period control unit sets an over-exciting period depending upon the time required from when said electromagnetic coil is excited until said valve body of said injector moves up to the fully opened position.

3. A device for controlling fuel injection according to claim 1, wherein said injector control unit supplies a holding current smaller than said over-exciting current to said electromagnetic coil over said exciting time after said over-exciting period has elapsed.

4. A device for controlling fuel injection according to claim 1, wherein said injection control means includes a fuel-pressure control unit for operating said fuel pressure that becomes a target of control for said fuel pressure regulator means, and said fuel pressure control unit functions as a fuel pressure sensor and inputs said fuel pressure that serves as the target of control to said over-exciting period control unit.

5. A device for controlling fuel injection according to claim 1, wherein said device further comprising a car-mounted battery, and said injector drive means directly applies the output voltage of said battery to said injector.

* * * * *